United States Patent [19]

Ganev et al.

[11] 4,410,357

[45] Oct. 18, 1983

[54] METHOD OF PURIFYING INDIUM

[75] Inventors: Tsviatko S. Ganev, Uppsala; Mats A. H. Jansson, Taby, both of Sweden

[73] Assignee: Telefonaktiebolaget L M Ericsson, Stockholm, Sweden

[21] Appl. No.: 410,577

[22] Filed: Aug. 23, 1982

[30] Foreign Application Priority Data

Feb. 2, 1982 [SE] Sweden ..... 8200829

[51] Int. Cl.[3] ..... C22B 58/00

[52] U.S. Cl. ..... 75/10 V; 75/63; 75/84

[58] Field of Search ..... 75/84, 10 R, 10 V, 62, 75/63

[56] References Cited

U.S. PATENT DOCUMENTS 2,901,342 8/1959 Siemons ..... 75/63

*Primary Examiner*—M. J. Andrews

*Attorney, Agent, or Firm*—Hane, Roberts, Spiecens & Cohen

[57] ABSTRACT

The invention relates to a method of purifying indium from silicon by baking an indium melt at a predetermined baking temperature in a crucible in a quartz container through which hydrogen gas having a predetermined water content, is flowed. According to the invention the quartz container is kept during the baking at a predetermined temperature that is lower than the baking temperature, and the surface skin of the melt is broken up at least once during the baking.

4 Claims, 2 Drawing Figures

METHOD OF PURIFYING INDIUM

TECHNICAL FIELD

This invention relates to a method of purifying indium from silicon by baking an indium melt at a predetermined baking temperature in a crucible held in a quartz container through which hydrogen gas having a predetermined water content, is flowed.

BACKGROUND ART

It is known to purify indium from silicon by baking an indium melt in an atmosphere containing water vapour. The method is based on the oxidation of the silicon in the melt to either silicon dioxide ($SiO_2$) or silicon monoxide. $SiO_2$ from the walls of the quartz container has hitherto been present at the baking temperature which imposes restrictions on the combinations of temperatures and water vapour pressures that can be used. The reason for this is that the reaction reverses, i.e., silicon is transported from the walls of the container to the melt in case the water vapour pressure is too low.

DISCLOSURE OF INVENTION

An object of the instant invention is to eliminate the disadvantages of the previously known methods.

This is attained according to the invention by keeping the quartz container at a predetermined lower temperature, with the surface skin of the melt being broken up at least once during the baking.

BRIEF DESCRIPTION OF DRAWING

The invention will be described more in detail below with reference to the accompanying drawing in which FIG. 1 schematically shows a longitudinal section of an embodiment of an apparatus for purifying indium from silicon.

MODES FOR CARRYING OUT THE INVENTION

Figure 1:
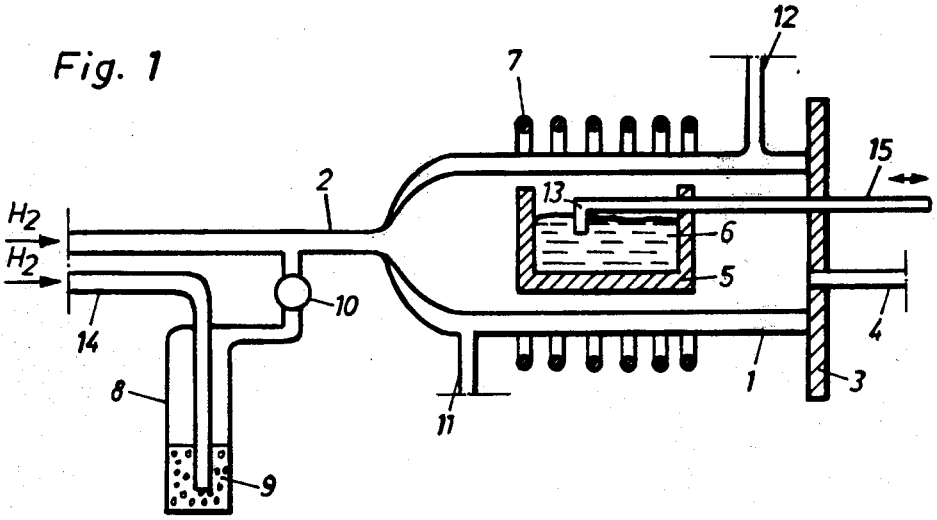

FIG. 1 shows a longitudinal section of embodiment of an apparatus for carrying the method according to the invention into effect for purifying indium from silicon. The apparatus shown in FIG. 1 includes a tubular, double-walled quartz container 1, one end of which being tapered for forming an inlet pipe 2 for hydrogen gas having a predetermined water content. The other end of the tube is closed by means of a lid 3 which is provided with a pipe socket 4 for discharging the hydrous hydrogen gas. In a manner known per se but not shown a crucible 5 is carried within the quartz container 1. The crucible 5 which is made of electrically conductive material, e.g. graphite, is charged with indium 6 to be purified from silicon and is inductively heated to a predeterminead baking temperature by means of an inductance coil 7. The coil is placed around the quartz container 1 and is connected to a generator (not shown) for supplying alternating current of radio frequency to the coil 7. The heating need not be inductive but can be accomplished by means of other known methods for heating of just the crucible.

In order to obtain a desired water content of the hydrogen gas supplied to the quartz container 1 part of the pure hydrogen gas to the inlet pipe 2 is passed through a pipe 14 via a bottle 8 with distilled water 9, and a valve 10 for adjusting the desired water content of the hydrogen gas that is supplied to the quartz container 1 via the inlet pipe 2. Instead of passing the hydrogen gas through the water bottle 8 the hydrogen gas can be mixed, e.g., with small amounts of oxygen gas.

In order to avoid heating of the quartz container 1 with resulting transportation of silicon from the container walls to the melt 6 a coolant, eg water, is pumped in the embodiment shown between the two walls of the quartz container 1 from an inlet pipe socket 11 to an outlet pipe socket 12. Thus, the quartz container 1 can be kept at a predetermined lower temperature than the baking temperature of the crucible 5. The quartz container 1 does not have to be double-walled and can also be cooled in another manner known per se.

During the baking at the predetermined baking temperature silicon leaves the indium melt 6 in the form of silicon oxide which is carried by the hydrous hydrogen gas flowing through the container 1 out through the outlet pipe socket 4 of the lid 3. By carefully selecting the water content of the hydrogen gas flowing through the quartz container 1 the forming of silicon dioxide on the surface of the melt 6 can be avoided. However, it has been noticed that other oxides, eg alumina, form a skin on the surface of the indium melt 6, which oxide skin stops the reaction between the water vapour and the silicon of the melt 6.

According to the invention this oxide skin on the surface of the indium melt 6 is broken up at least once during the baking. This can of course be accomplished in a number of different ways but is accomplished by the embodiment shown by means of a rake 13, the operating rod 15 of which being displacable through the lid 3 as well as through one end wall of the crucible 5. The purpose of the breaking up of the oxide skin is to bring the gas flowing through the container into contact with a comparatively large free surface of the melt.

Figure 2:
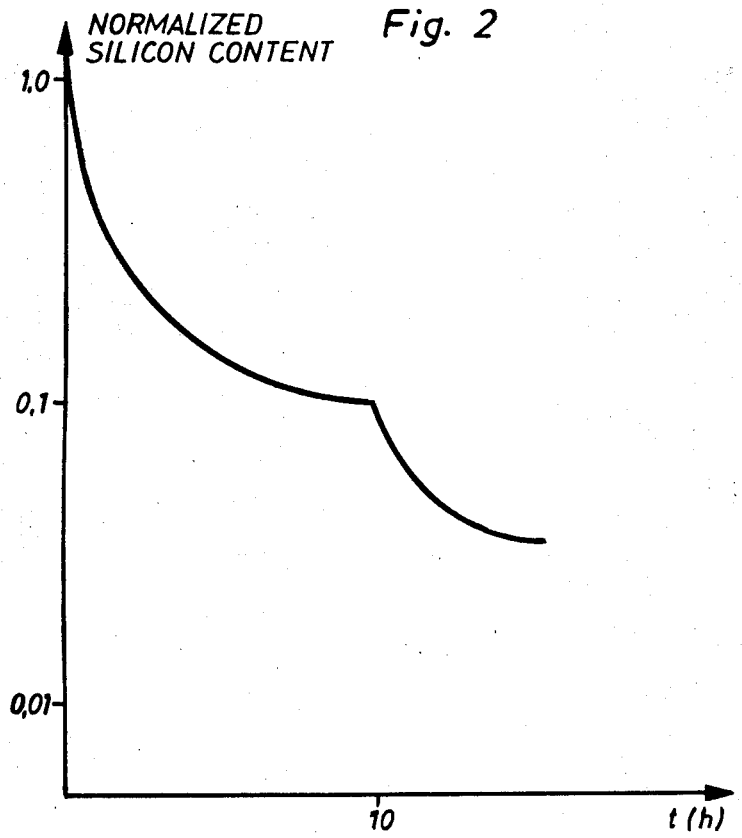
FIG. 2 shows the silicon content (normalized to the value at the beginning of the baking) in an indium melt as a function of the baking time at a predetermined water content.

The effect of the scraping is shown in FIG. 2 that shows the logarithm of the silicon content (normalized to the value at the start of the baking) in the indium melt 6 as a function of the logarithm of the baking time at a predetermined water content of 2 ppm. The baking temperature was 800° C. As apparent from FIG. 2 the silicon content reaches a stable level, corresponding to about 1/10 of the original value, after a baking time of about 10 h. At that time the surface skin of the melt 6 is broken up by means of the rake 13 whereupon the silicon content of the melt 6 again begins to decrease. Then, the scraping is repeated a suitable number of times until a desired low silicon content has been reached. In order to be able to determine that the silicon content has reached the desired level the silicon content must be measured in a manner known per se.

In the embodiment of the apparatus for carrying out the method according to the invention, shown in FIG. 1 the baking of the indium melt 6 is assumed to take place at atmospheric pressure. It is of course possible to carry out the baking at a pressure that is lower than atmospheric pressure. The reason for carrying out the baking at such a lower pressure is that the removal of silicon monoxide goes faster. In this case the quartz container 1 must be evacuated in a manner known per se by means of a vacuum pump (not shown).

We claim:

1. A method of purifying indium from silicon comprising the steps of baking an indium melt containing silicon at a predetermined baking temperature in a crucible positioned in a quartz container, maintaining the quartz container at a given temperature lower than the predetermined baking temperature, passing a hydrogen gas with a predetermined water content through said quartz container and over the indium melt in said crucible whereby the silicon leaves the indium as silicon oxide, and breaking up the surface skin of the indium melt at least one during the baking.

2. The method of claim 1 wherein the crucible comprises conductive material, and wherein the the crucible is inductively heated.

3. The method of claim 1 wherein the surface skin is scraped by means of a rake.

4. The method of claim 1 wherein the baking is carried out at a pressure that is lower than atmospheric pressure.

* * * * *